US005385421A

United States Patent [19]

Morgan et al.

[11] Patent Number: 5,385,421

[45] Date of Patent: Jan. 31, 1995

[54] FAIL-SAFE COMPOSITE-CAST METAL STRUCTURE

[75] Inventors: Mark R. Morgan, Dayton; Harry J. Couch, Tipp City, both of Ohio

[73] Assignee: General Motors Corporation, Detroit, Mich.

[21] Appl. No.: 260,508

[22] Filed: Jun. 15, 1994

Related U.S. Application Data

[63] Continuation of Ser. No. 2,449, Jan. 8, 1993, abandoned, which is a continuation-in-part of Ser. No. 660,202, Feb. 25, 1991, Pat. No. 5,195,571.

[51] Int. Cl.[6] ..... B22D 19/04; B22D 19/14

[52] U.S. Cl. ..... 403/272; 164/98; 164/111

[58] Field of Search ..... 164/98, 111, 120; 403/266, 267, 270, 271, 272

[56] References Cited

U.S. PATENT DOCUMENTS

| | | | |
|---|---|---|---|
| 2,240,982 | 5/1941 | Clark | 403/266 X |
| 4,085,307 | 4/1978 | Jenkins | 219/98 |
| 4,110,650 | 8/1978 | Kemp et al. | 403/265 X |
| 4,337,817 | 7/1982 | Komatsu et al. | 164/120 |
| 4,444,516 | 4/1984 | Dostoomian et al. | 374/131 |
| 4,585,368 | 4/1986 | Pagan | 403/266 |
| 4,602,892 | 7/1986 | Brookstein et al. | 403/265 |
| 4,606,395 | 8/1986 | Ban et al. | 164/98 |
| 4,648,921 | 3/1987 | Nutter, Jr. | 156/77 |
| 4,652,171 | 3/1987 | Schütze | 403/267 X |
| 4,813,590 | 3/1989 | Deakin | 228/120 |
| 4,872,370 | 10/1989 | Benton et al. | 403/271 X |
| 4,990,207 | 2/1991 | Sakai et al. | 156/242 |
| 5,027,497 | 7/1991 | Takaki et al. | 403/267 X |
| 5,195,571 | 3/1993 | Morgan et al. | 164/98 |

FOREIGN PATENT DOCUMENTS

| | | |
|---|---|---|
| 0280830 | 9/1988 | European Pat. Off. . |
| 0391406 | 10/1990 | European Pat. Off. . |
| 59093548-A | 11/1982 | Japan . |
| 60110830-A | 11/1983 | Japan . |
| 60141362-A | 12/1983 | Japan . |
| 60184653-A | 2/1984 | Japan . |
| 62003862-A | 6/1985 | Japan . |
| 1192858-A | 1/1988 | Japan . |
| 6390350-A | 4/1988 | Japan . |
| WO86/04650 | 8/1986 | United Kingdom . |
| 2225743-A | 6/1990 | United Kingdom . |

OTHER PUBLICATIONS

Research Disclosure #27638 "Cast-In-Situ Joint for Tubular Beams", Apr. 1987, pp. 209–210.

*Primary Examiner*—Randolph A. Reese
*Assistant Examiner*—Christopher J. Novosad
*Attorney, Agent, or Firm*—Anthony L. Simon

[57] ABSTRACT

A method for manufacturing a structural component includes forming a groove in an outer surface of a fiber reinforced body. Molten metal is introduced to an exposed surface of the groove and to a predetermined portion of the outer surface of the body. The metal is cooled in a controlled manner to thermally alter sufficient resin to create a secure interconnection of the metal on the body. The metal adjacent the groove is sized so that it will fail prior to separation of the metal from the body under excessive tensile loads. A portion of the metal remains on the body so that elongation of the component significantly exceeds ultimate elongation of the fiber reinforced body and the cast metal.

9 Claims, 7 Drawing Sheets

FAIL-SAFE COMPOSITE-CAST METAL STRUCTURE

This is a continuation of application Ser. No. 08/002449 filed on 08 JAN. 1993, now abandoned, which is a continuation in part of application Ser. No. 07/660,202 filed 25 FEB. 1991, now U.S. Pat. No. 5,195,571 issued 23 MAR. 1993.

CROSS-REFERENCE TO RELATED APPLICATION

This application is related to application Ser. No. 07/660,202, filed Feb. 25, 1991.

BACKGROUND OF THE INVENTION

1. Field of the Invention

The present invention relates generally to a method of die cast molding a metal directly onto a fiber reinforced plastic body to form a structure. In particular, a structure formed pursuant to this method includes a preselected failure site to control separation of the cast metal from the plastic body when the structure is subjected to excessive tensile loads.

2. Description of the Related Art

Links, generally formed as elongated metallic members having eyelets on each end, are well-known in the automotive industry. In particular, links are used to connect various components in a suspension system. In use, a link can be subject to compressive, tensile and shear loads.

It is desirable to substitute lighter materials for traditional metals such as aluminum to form links. Fiber reinforced plastic, typically referred to as FRP, may find increasing usage in the automotive industry, despite its higher cost, because of its high strength to weight ratios. However, one problem with substituting FRP for metal in any automotive component is the fact that it is difficult or impossible to form it into shapes that are convoluted or discontinuous. Thus, it may serve well as a drive shaft, which is an elongated tube of constant cross section, but not as a transmission case, with its labyrinthine internal passages.

Another limitation is that many automotive components must be attached directly to another metal component at some point, which may require that the FRP component be provided with a localized metal fastening member. For example, an FRP drive shaft must have a metal connector at each end for attachment to the remainder of the drive line. It is difficult to successfully and securely mate FRP directly to metal, especially when the attachment point will be subject to heavy loading and stress. Many patents are directed just to the problem of joining metal end pieces to FRP drive shafts, most of which involve various adhesives, rivets, splines or combinations thereof.

The designer of an FRP link would face both problems noted above. The main body of a link is basically a rod or beam with a fairly constant cross section and smooth exterior surface, presenting no particular protrusions or discontinuities. This is a basic shape that would lend itself well to FRP manufacture. A matrix of full length reinforcing glass fibers soaked with a conventional thermosetting resin is formed in a mold with the desired beam shape, and then heat cured. However, each end of the beam must be connected to other structures, e.g., between a suspension support and a wheel assembly support. Die casting a metal eyelet directly to the end of an FRP beam would be preferable, in terms of time, cost and strength, to attaching a separate connector by adhesive or mechanical means. However, the thermoset resin that binds the fibers together decomposes badly at the melting temperatures of suitable metals, such as aluminum alloy. Tests that subjected FRP to molten metal for times comparable to the cycle times involved in standard die casting operations found such severe thermal decomposition of the resin as to conclude that the process would not be feasible.

A particular aspect of a joint between an FRP body and a metal must be addressed when the component is subject to tensile loads. Under excessive tensile loads, the metal may completely pull away from the FRP member. If the component is a link, e.g., a FRP rod connected to a metal eyelet, complete separation of the eyelet from the rod under excessive tensile loads is unsatisfactory.

SUMMARY OF THE INVENTION

The present invention includes a method for making a structure in which metal is die cast directly onto a fiber reinforced plastic body. Thermal alteration of the binding resin results in a bonding interface between the FRP body and metal. Furthermore, the structure is formed so that if excessive tensile loads are incurred, a preselected failure will occur in the metal prior to the complete separation of the metal from the FRP body. This preselected failure provides a safety factor in load-carrying applications such as links since the bonding interface between a portion of the metal continues to resist separation from the FRP body.

The present invention includes a method for manufacturing a structural component including the step of forming a groove in an outer surface of a fiber reinforced body. Molten metal is introduced to an exposed surface of the groove and to a predetermined portion of the outer surface of the body. The metal is cooled in a controlled manner to thermally alter sufficient resin to create a secure interconnection of the metal on the body. The metal adjacent the groove is sized so that it will fail prior to separation of the metal from the body under excessive tensile loads. A portion of the metal remains on the body so that elongation of the component significantly exceeds ultimate elongation of the fiber reinforced body and the cast metal.

DESCRIPTION OF THE PREFERRED EMBODIMENTS

Figure 1:
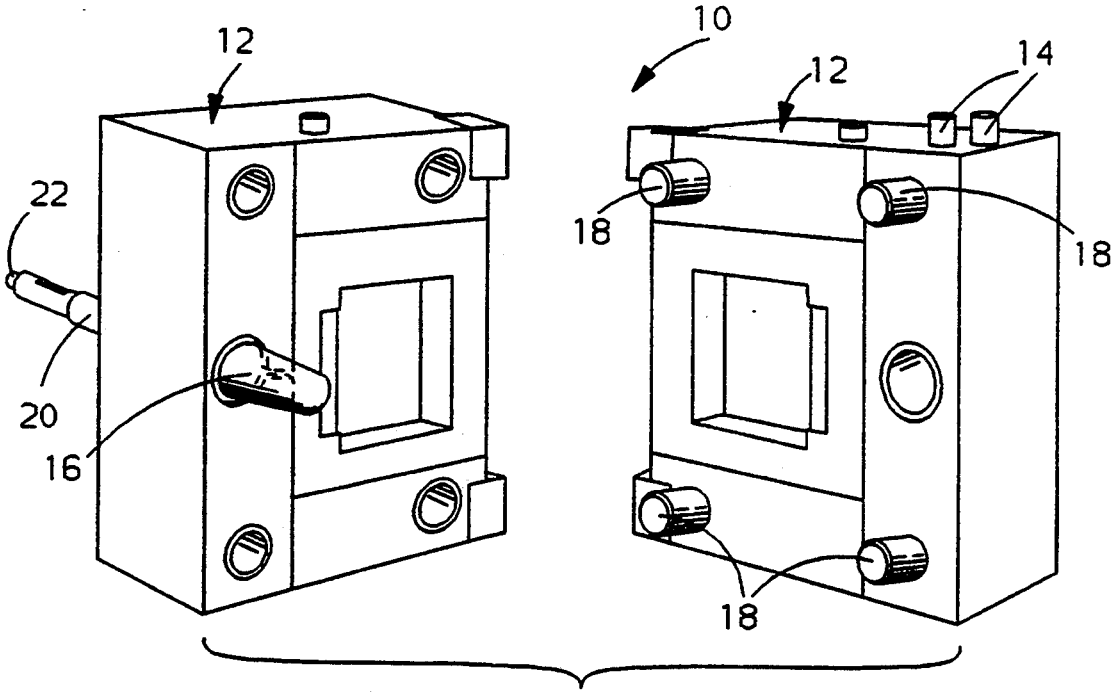
FIG. 1 is a perspective view of a molding apparatus illustrating a pair of larger master dies designed to contain a pair of smaller unit dies, which are removed for ease of illustration.

A molding apparatus for use with the present invention is illustrated as a cold chamber die casting machine indicated generally at 10 in FIG. 1. Machine 10 is of the type that has two main halves, called die holders or master dies 12. The master dies 12 are the foundation of the apparatus, supporting such features as cooling water lines 14, a sprue spreader 16, and leader pins 18. A shot chamber 20 and plunger 22, illustrated best in FIG. 2, which are used to send a charge of molten metal 24 into the machine 10 are supported on the master die 12 opposite the sprue spreader 16. Detailed information about metal 24 is presented below. The master dies 12 support a pair of smaller unit dies, indicated generally at 26 and 28. It is the unit dies 26 and 28 that actually form the molded shape desired, allowing machine 10 to be used to make several different components.

Figure 3:
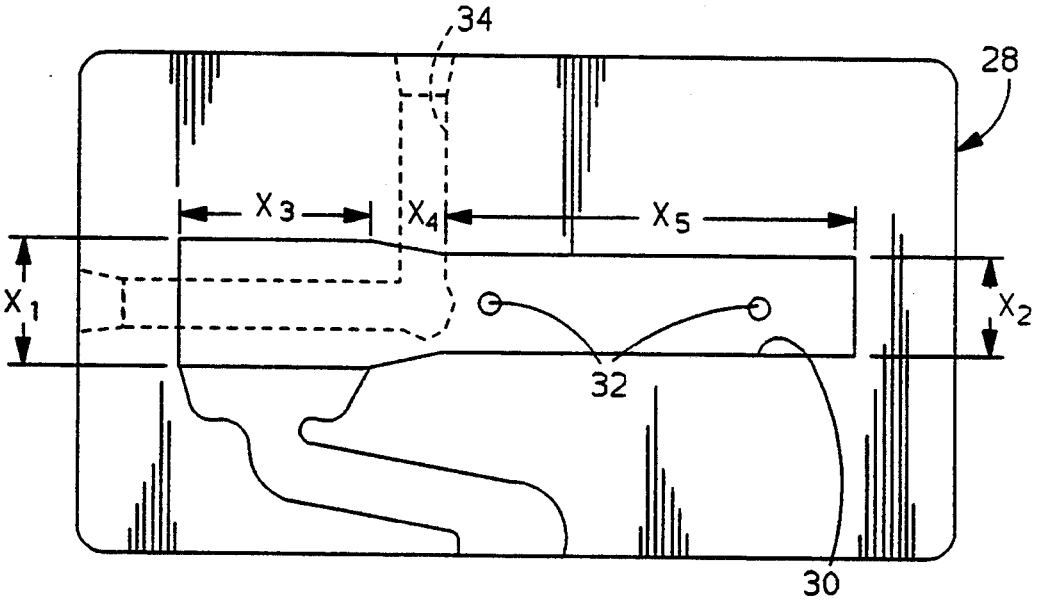
FIG. 3 is plan view of one of the unit dies designed for the master dies of FIG. 1, illustrating a cavity machined therein.
Figure 4:
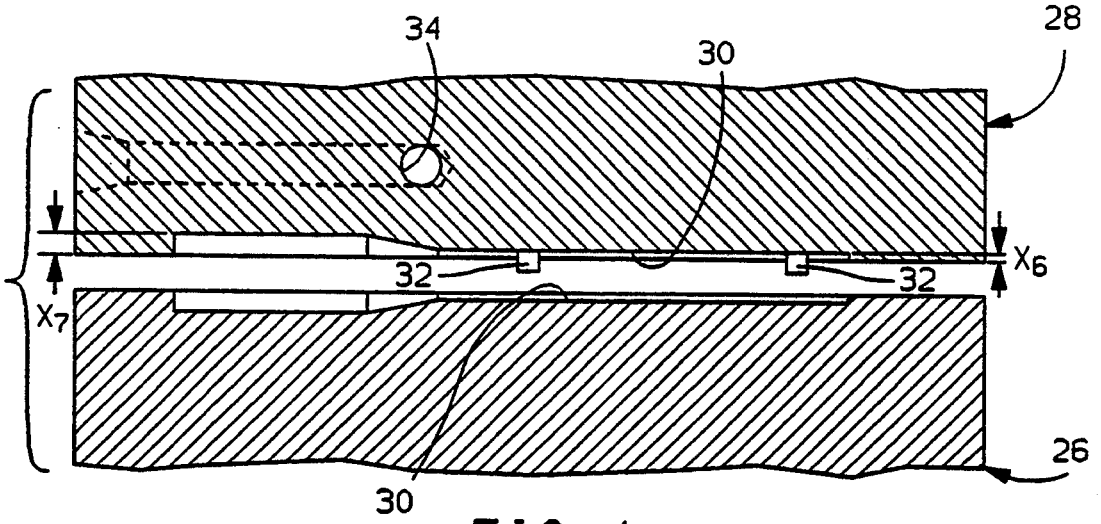
FIG. 4 is a sectional view of two unit dies spaced apart, illustrating the plane in which they part.

Each unit die 26 and 28 is a steel block, measuring nine by three by five inches, and therefore provides a significant heat sink mass in and of itself. Furthermore, each unit die 26 and 28 makes intimate surface to surface contact with the interior of the master die 12 that supports it, thereby providing additional heat sink mass. Each unit die 26 and 28 has a matching cavity 30 (FIGS. 3 and 4) machined therein, the basic dimensions of which, $X_1$ through $X_7$ in inches, are 1.25, 1.0, 2.0, 0.75, 4.25, 0.125, and 0.25 respectively. An enlarged end is formed in each cavity 30. Unit die 28 has a pair of locator pins 32 in its cavity 30 as well as a cooling water passage 34, but is identical to unit die 26 otherwise. In use, the unit dies 26 and 28 would be vertically opposed to one another, but are shown horizontal in FIG. 4 for ease of illustration. While machine 10 as disclosed is basically conventional, it should be understood that it would normally be used simply to cast a solid part of metal only.

Figure 6:
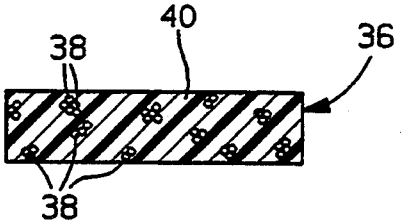
FIG. 6 is a sectional view of the FRP body taken along the line 6—6 of FIG. 5.
Figure 5:
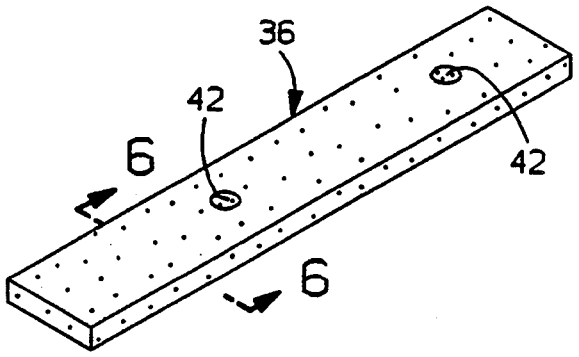
FIG. 5 is a perspective view of a FRP body.

One of the two constituents of the structural component produced by the method of the present invention is a compression molded FRP body, indicated generally at 36 in FIGS. 5 and 6. Body 36 is a short beam of constant rectangular cross section, with a six inch length, one inch width, and a quarter inch thickness. It is manufactured by first laying up a matrix of full-length glass reinforcing fibers 38 lengthwise within a mold that has the same shape as body 36. The content of fibers 38 is about 72% by weight. Then, a thermo-setting resin 40, which in this case is an amine cured bisphenol-A epoxy system, is injected around the bundle of fibers 38. The composite is then heat cured under pressure in the mold at 250 degrees F. for approximately ten minutes, and post cured out of the mold at 310 degrees F. for about fifteen minutes. Finally, a pair of holes 42 are drilled to match the locator pins 32 of unit die 28.

The temperature sensitivity and responsiveness of the fibers 38 and resin 40 as compared to metal 24 is important. Metal 24 is a standard 380 aluminum alloy, which is commonly used in die casting, and which has a melting point of 1220 degrees F. While the glass fibers 38 can withstand such a high temperature, this temperature is substantially beyond the temperature that the resin 40 could be expected to withstand without suffering very significant decomposition, even to the point of total structural failure of the part. In fact, tests showed that a sample like body 36, when dipped into molten aluminum for a time comparable to a normal molding cycle timer did suffer debilitating thermal decomposition. Thus, it was expected that an untreated, unprotected part like body 36 would never survive having aluminum die cast to it. Nevertheless, a method for doing so was developed and is described next.

Figure 2:
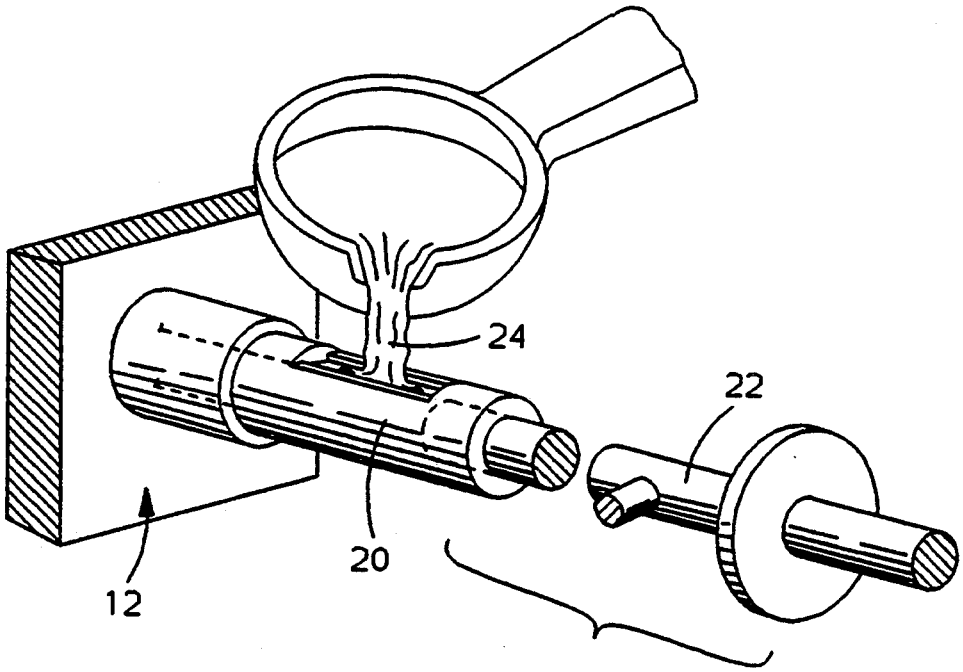
FIG. 2 is a perspective view of a shot chamber that feeds a charge of molten metal into the molding apparatus of FIG. 1.
Figure 7:
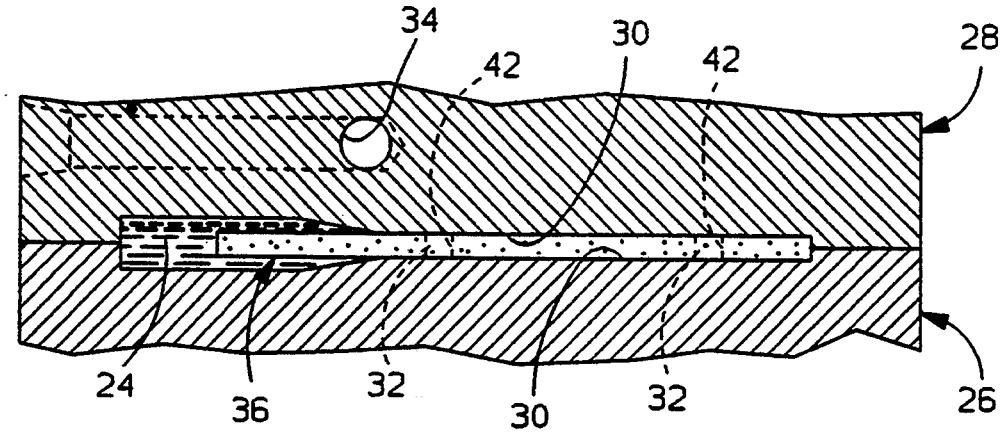
FIG. 7 is a sectional view of the two unit dies closed together with the FRP body supported between them and extending into the mated cavities.

The basic steps of the present die cast molding method are illustrated in FIGS. 7 and 2. First, body 36 is supported by inserting locator pins 32 though holes 42. Then, the unit dies 26 and 28 are closed. While most of the length of body 36 is closely contacted and pinched off by the inner surfaces of the cavities 30, an end of body 36 extends freely into the enlarged ends of the mated cavity 30. An unobstructed volume or chamber is thereby created that completely surrounds the end of body 36. The interior surfaces of the enlarged ends of the mated cavities 30 are close to the exterior surface of the end of body 36, so the surrounding chamber they create is symmetrical, with a basic thickness of one eighth of an inch, as measured perpendicular to the surface of body 36. Next, a charge of molten metal 24 is forcibly pushed in from shot chamber 20 by plunger 22, and fills the chamber around the end of body 36 completely in less than a tenth of a second. Non-illustrated vents and wells in the unit dies 26 and 28 are provided to accommodate the displaced air as the molten metal 24 enters under pressure.

Figure 8:
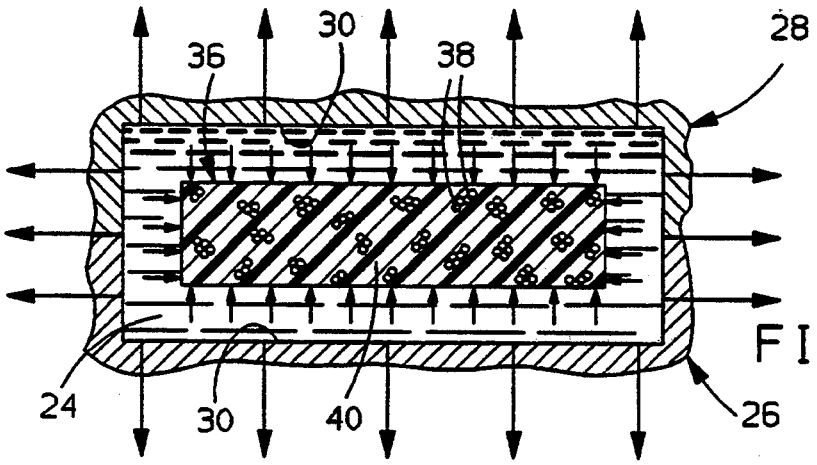
FIG. 8 is a sectional view taken through the unit dies of FIG. 7 after injection of metal around the end of the FRP body and schematically showing the heat flow therefrom.

As seen in FIG. 8, an inner jacket or envelope is established at the interface of metal 24 with the external surfaces of body 36, and a surrounding outer jacket or envelope at the interface between metal 24 and the inner surfaces of the cavities 30. A relatively rapid outer heat flow from metal 24 to the unit dies 26 and 28 is immediately established at the outer envelope, which is visually represented by the longer arrows. The radially outward heat flow from metal 24 results from the large heat sink mass of the unit dies 26 and 28 and the master dies 12, an effect that is aided by the circulation of cooling water through water lines 14 and water passage 34. Water is pumped through at a flow rate of approximately 20 gallons a minute. Heat flow from metal 24 is also kept rapid and even by the relative thinness of the filled volume around the end of body 36, and by the symmetry of the volume described above. The unit dies 26 and 28 are kept closed for about ten seconds, after which time the metal 24 cools to about 500 degrees F and solidifies. The steady state operation temperature of the unit dies 26 and 28 has been measured to be about 350 degrees F.

Figure 9:
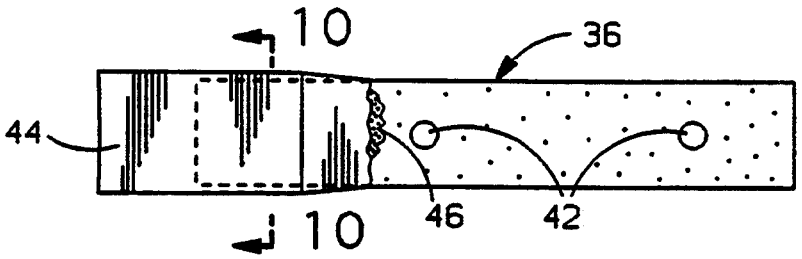
FIG. 9 is a plan view of the completed part, showing a flow of melted resin that has squeezed out of the FRP-metal interface.

The end product is illustrated in FIG. 9. After ten seconds, the unit dies 26 and 28 are opened and the completed part, consisting of body 36 and now solidified metal end member 44, is ejected and water cooled to room temperature. After removal, a black substance is sometimes observed to ooze out and solidify in a small, shiny pool indicated at 46 at the joint between the surface of body 36 and metal member 44, which is further explained below. Clearly, the body 36 has not decomposed or burned to the point where it has eaten through or fallen off, but its response to heavy loading is more important to proof of production feasibility. In fact, the completed part is not used as an actual component, but as a tensile test specimen to indicate that feasibility. It is held by the holes 42 in a test machine and a measured pulling force applied to metal member 44. Tensile loads of approximately 1400 pounds have been achieved. Since a component like a wiper arm would have a body shaped much like body 36 and a metal end connection member similar to member 44, which could be later drilled, machined, splined or otherwise shaped. This is impressive evidence of production worth. Two phenomenon are thought to contribute to the success of the process and the strength metal to body bond. One is clearly the rapid and even cooling of the molten metal 24, which protects the body 36 from excessive damage. Even more important, however, is what happens at the inner envelope, described next.

Figure 10:
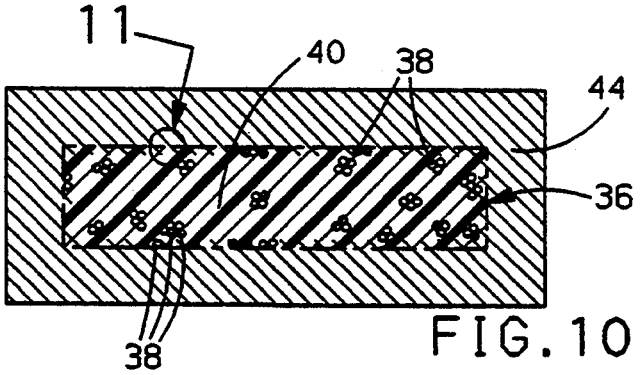
FIG. 10 is a sectional view taken along the line 10-10 of FIG. 9, showing schematically the interlock of the metal with the fibers exposed at the surface of the FRP body.
Figure 11:
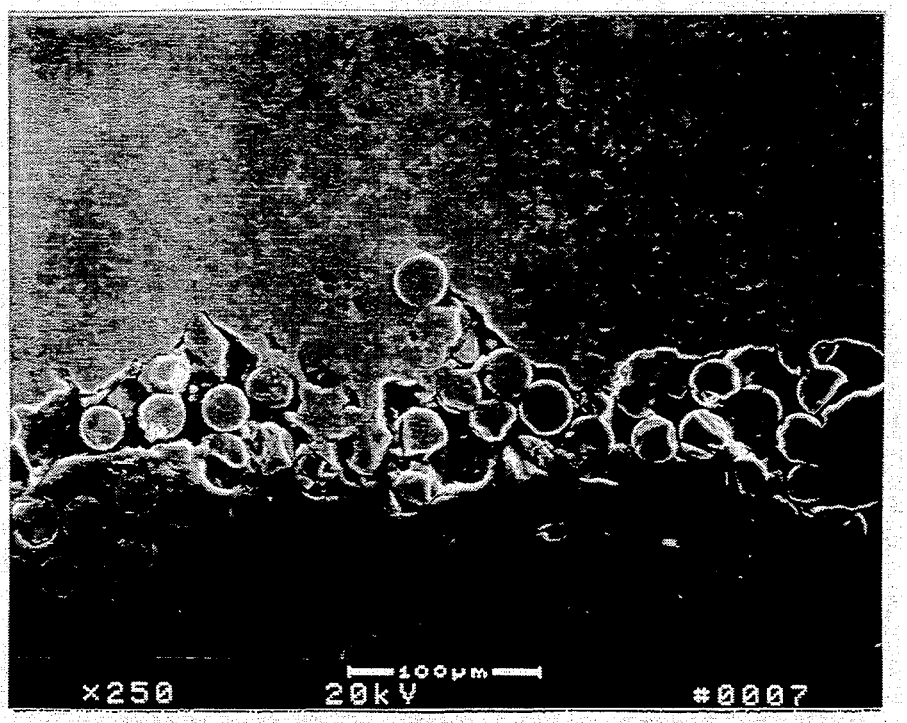
FIG. 11 is an actual photomicrograph taken with a scanning electron microscope at approximately 250X magnification, showing an enlarged circled portion of the interface of FIG. 10.

The action at the interface between molten metal 24 and the exterior surface of the end of body 36 is illustrated in FIGS. 8–11. The heat flow out of molten metal 24 is not so rapid that no heat flows radially inwardly therefrom to the surface of body 36. Instead, a radial inward heat flow to the surface of body 36 is established, represented by the shorter arrows in FIG. 8. Just as with the outward heat flow, the rate is kept relatively even by the symmetry of the surrounding volume. While the temperature at the metal-FRP surface interface has not been directly measured, it has been observed from laboratory tests that resin like resin 40 begins to decompose at between seven and eight hundred degrees F. It appears that the temperature at the surface of body 36 must approach that temperature, because it is clear from two observed phenomenon that some of the resin 40 at the upper surface layer of body 36 does decompose, a phenomenon represented by the phantom line in FIG. 10. One observation is the solidified outflow 46. This is clearly melted or otherwise liquefied resin 40, at least in part, since it is not metal and the glass fibers 38 will not melt even at the melting temperature of the metal 24. More telling is what is observed by cutting, polishing and observing the interface under magnification, as seen in FIGS. 10 and 11. The resin 40 has clearly degraded over a layer varying from about 30 to 70 micrometers in thickness, exposing some of the fibers 38. The metal 24 has clearly flowed amongst and around the exposed fibers 38, creating a secure interlock and interconnection therewith.

While it is clear that it does occur in fact, the exact mechanism of the thermal degradation of resin 40 is not exactly understood. It apparently gasifies, and in some cases at least, condenses and liquefies again, witness pool 46. Clearly, the decomposition process is limited in effect and depth, as it does not structurally threaten the part. An important factor in the control and limitation of the level of thermal decomposition is the rapid and even cooling of the metal 24 so that not too much resin 40 is lost. Another controlling and limiting factor may well be the exposed layers of fibers 38 themselves acting as insulation against the heat, and the fiber content of body 36 is relatively high. Other control factors may be the exclusion of air by the close fill of the molten metal 24, or the pressure that it is under. It is very significant that the thermal decomposition process is limited and controlled, by whatever mechanism, as opposed to being prevented altogether. A logical approach, knowing that the molten metal 24 was far hotter than necessary to induce rapid thermal decomposition of the resin 40, would be to try to prevent it from occurring at all, or at least substantially, by more rapid cooling, or by deliberate heat insulation and protection of the outer surface of body 36 over that portion to be contacted by molten metal 24. In fact, this was tried with various thermal barrier materials, such as stainless steel flakes and silica, which were also test cast with a metal having a lower melting temperature. While thermal loss of resin was substantially prevented, the metal to FRP surface joint was not nearly so strong.

Variations of the process should be possible within the basic outlines disclosed. Most broadly conceived, the idea is to introduce molten metal directly to the surface of the FRP part, and then cooling and time limiting its contact sufficiently to expose a top layer of reinforcing fibers around which molten metal may flow and interlock with. As disclosed, the molten metal is introduced in surrounding relation to an external surface of an FRP part, but it could conceivably be poured directly into a concavity in the part, with no mold, and cooled by some other means. More could be done to tailor the characteristics of the FRP fibers and resin to the molten metal and vice versa so as to achieve the desired result, such as increasing the fiber content at the surface, or experimenting with different metals, temperatures, or even surface coatings that provide some, but not a complete, thermal barrier. For example, it is thought that the shrinkage of the cooling aluminum around the end of body 36 aids in creating the bond. Other metals might shrink even tighter. Each designer will undoubtedly experiment with different cooling rates, metal thicknesses and cycle times so as to achieve the optimum level of the resin degradation and metal interlock that has been discovered here. While the symmetry of the chamber surrounding the end of body 36 aids in even cooling, asymmetric shapes could be molded, as well. Judicious placement of cooling lines could be used to control the cooling rate. Therefore, it will be understood that it is not intended to limit the invention to just the embodiment disclosed.

Figure 12:
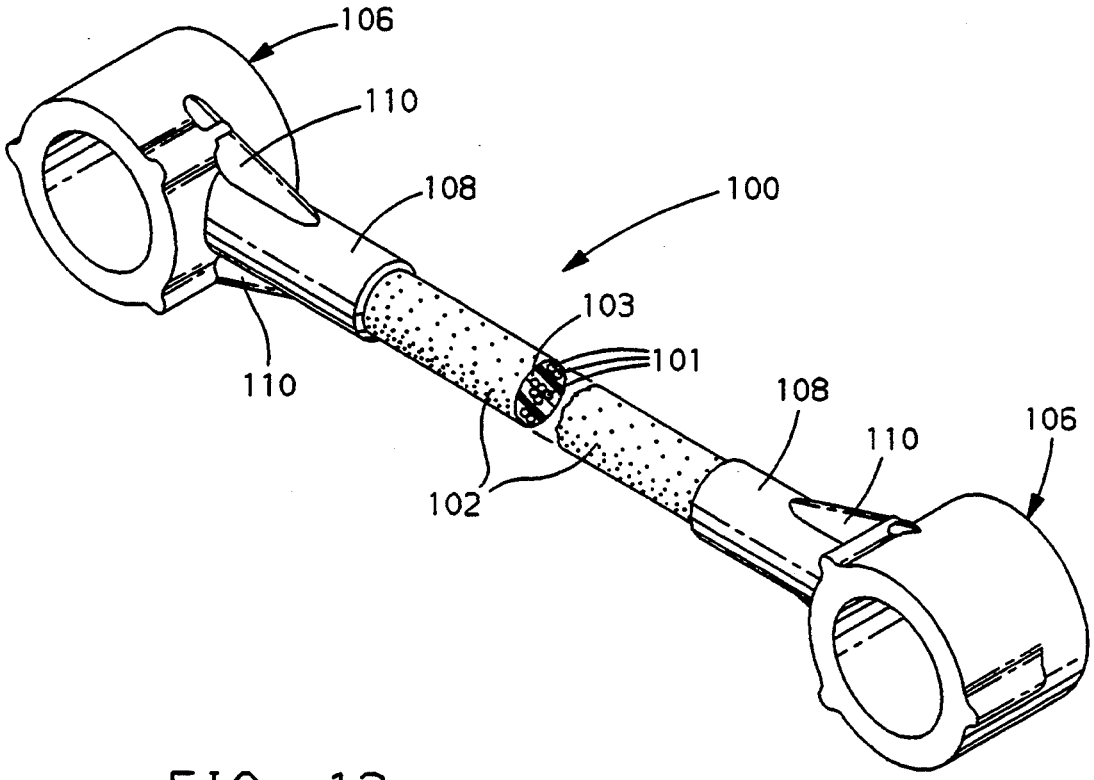
FIG. 12 is a perspective view of a link having a FRP rod and a pair of opposite eyelets, each eyelet having a neck receiving the rod.
Figure 15:
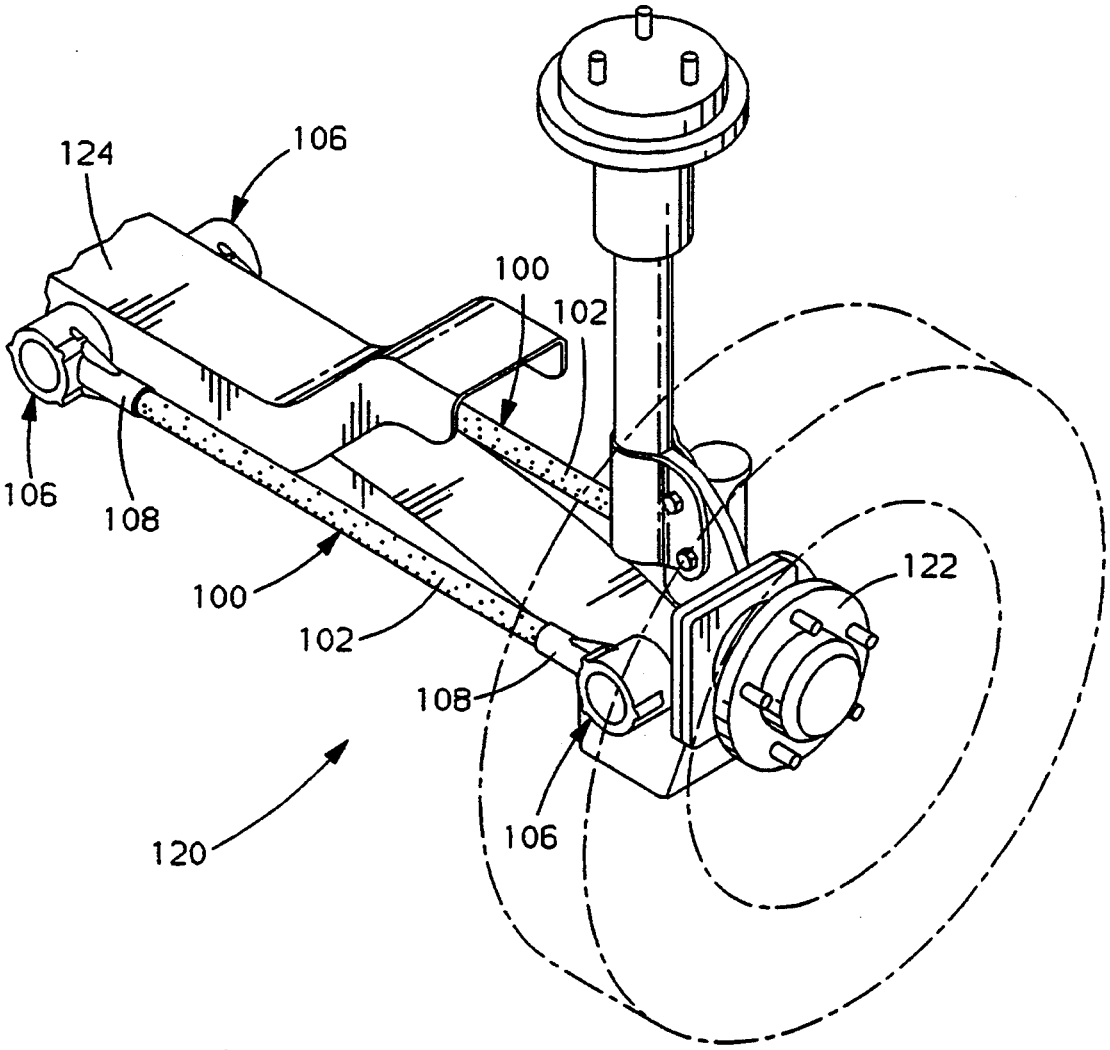
FIG. 15 is a perspective view of a vehicular suspension system illustrating the link of FIG. 12 connecting a knuckle and spindle assembly to a suspension cradle.

While body 36 was designed as a tensile test specimen, an automotive link formed according to the die cast molding method described above is indicated generally at 100 in FIG. 12. The link 100 can be designed for compressive and tensile loading, and can be adapted for a variety of applications, including between a knuckle and spindle assembly 122 and a cradle 124 in a vehicular suspension system 120 illustrated in FIG. 15.

Such a suspension link 100 is a load bearing member subjected to alternating tensile and compressive forces during operation of a vehicle. Various elastomeric bushings (not illustrated) and fasteners (not illustrated) can be used to secure each end of the link 100 to a desired support.

The completed part, i.e., the link 100, includes an elongated rod 102. The rod 102 is a FRP body made with full-length glass reinforcing fibers 101 in a thermosetting resin 103. The rod 102 is preferably formed by a pultrusion process. In this process, continuous fibers 101 are pulled into a resin wet out bath where the fibers 101 are saturated with liquid resin 103. Then, the fibers 101 are drawn from the bath through a squeeze out die, which controls the fiber/resin ratio, and into a heated final forming die where the thermo-setting resin 100 hardens and cures. The solid composite is pulled out of the final forming die by in-line pulling units which grip the composite and work in tandem to pull material through the entire process continuously. A flying cut-off unit cuts the composite into predetermined lengths.

A circumferential groove 104 is provided at a predetermined depth and width near each end portion of the rod 102. Preferably, the rod 102 has a smooth, continuous outer circumference and the groove 102 is a uniform channel cut in the circumference. However, other rod cross sections and groove configurations are within the scope of the invention.

A casting is formed as an eyelet 106 in unit dies similar to unit dies 26 and 28, wherein the unit dies have suitably formed cavities. Each eyelet 106 includes a neck 108 to accept a predetermined length of the rod 102. Each groove 104 is cut in the rod 102 so that the neck 108 extends past the groove 104 a predetermined distance. Webs 110 can be provided on the outer surfaces of the eyelet 106 and neck 108 to strengthen the casting.

Molten metal 24, such as a standard 380 aluminum alloy, is introduced to unit dies supporting the rod 102 according to the die cast molding method disclosed above. As the molten metal 24 solidifies, an annular projection 114 is formed in the inner diameter of the neck 108 which extends radially inwardly to completely fill the groove 104. The resin 103 at the outer circumference of the rod 102 and the exposed surface of the groove 104 undergoes thermal alteration and exposes glass fibers 101. As described above, even cooling of the molten metal 24 protects the rod 102 from excessive damage. The joint formed between the projection 114 and the groove 104 and between the rod 102 and the neck 108 is referred to as the interlocking region.

Figure 13:
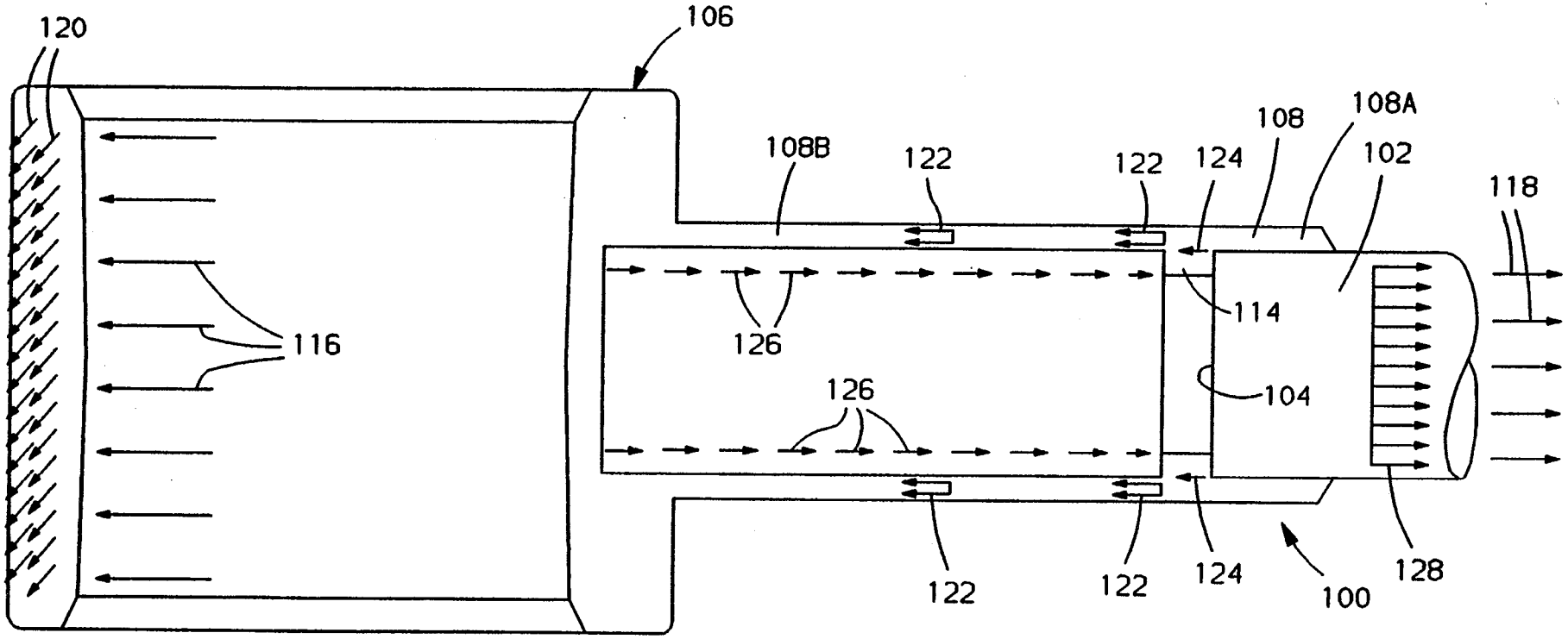
FIG. 13 is a sectional view through the left eyelet and a portion of the FRP rod of FIG. 12 without sectional cross-hatching illustrating tensile and shear stresses occurring during tensile loading of the link.

FIG. 13 schematically illustrates tensile loading in the link 100. The tensile load in the eyelet 106 is indicated by arrows 116 and the tensile load in the rod is indicated by arrows 118. This tensile loading produces mechanical stresses in five locations within the link 100. Bending stresses present in eyelet 106 are illustrated at 120. Tensile stresses in the neck 108 are illustrated at 122. Tensile stresses in the rod 102 are illustrated at 128. Shear stresses 126 are present in the portion of the rod 102 from the annular projection 114 to the end of the rod 102. Shear stresses 124 are present in the annular projection 114.

Stress in any material causes the material to elongate. If the elongation exceeds the ultimate elongation of the material, the material will begin to crack and fail. Both materials used to fabricate the link 100 have a low ultimate elongation and are brittle materials. The aluminum at eyelet 106, neck 108, and annular projection 114 has an ultimate elongation of 3%. The FRP in the composite rod 102 has an ultimate elongation of 2.5% A brittle material tends to fail very rapidly after a crack forms.

It would be expected that if the stress at any one of the five locations within the link 100 caused the respective ultimate elongation to be exceeded, the respective material would crack and rapid failure would result. However, failure at a selected site of the five locations does not exhibit a rapid, brittle failure. The present design is intended to create failure at this selected location during extreme tensile loading of the link 100.

The location in the link 100 which does not exhibit a rapid, brittle failure during extreme tensile loading is the portion of the neck 108 adjacent the annular groove 104. At this location tensile stress 122 and shearing stress 124 are present in the aluminum. In addition the sharp corner of the annular groove 104 creates a stress concentration factor which amplifies stresses 122 and 124. Thus, the portion of the neck 108 adjacent the annular projection 114 is made weaker than the eyelet 106, the rod 102 in a tensile mode, and the rod in a shear mode.

Figure 14:
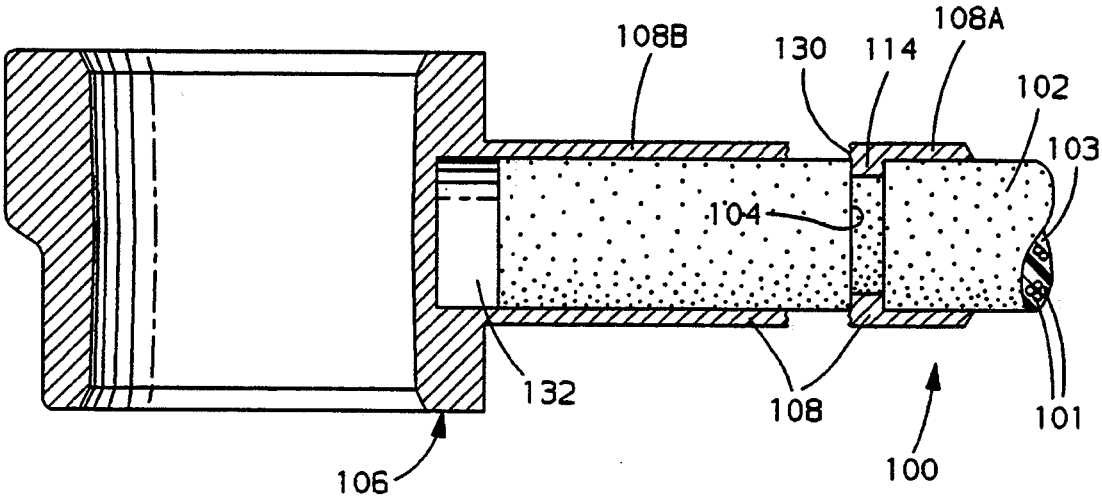
FIG. 14 is a view similar to FIG. 13 illustrating the fracture of the neck due to extreme tensile loading and the retention of the rod in the remaining neck portion.
Figure 16:
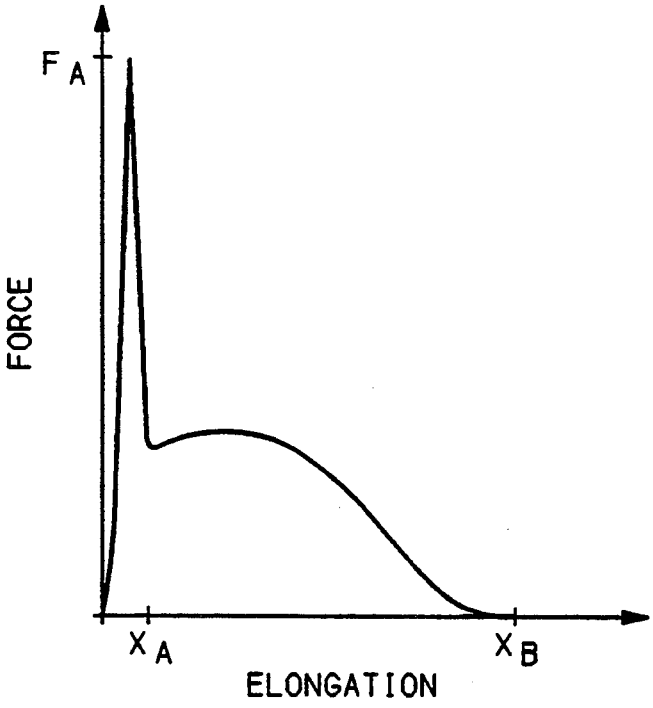
FIG. 16 is a graph schematically illustrating the elongation of the link of FIGS. 12–15, marked to indicate the fracture of the neck at $X_A$ and the separation of the rod from an outer portion of the neck at $X_B$.

Under high tensile loading, a crack 130 develops in an inner surface of the neck 108 adjacent projection 114 and propagates to the outer surface of the neck 108, eventually causing an inner portion 108A of the neck 108 to break away from an outer portion 108B of the neck 108 as illustrated in FIG. 14. However, the fracture of the neck 108 does not result in immediate separation of the rod 102 from portion 108B. As schematically illustrated in FIG. 16, tensile loading of the link 100 increases to $F_A$, at which point the neck 108 fractures into portions 108A and 108B after an elongation of $X_A$. Subsequently, a varying force is required to pull the rod 102 from the outer neck portion 108B for a total elongation of $X_B$. As the rod 102 pulls away from the outer portion 108B of the neck 108, a chamber 132 is formed.

A significant amount of energy is required to completely separate the eyelet 106 from the rod 102. This is due to the penetration of the alloy into the composite as described above. Testing has shown the amount of elongation of the link 100 is much greater than the ultimate elongation of the materials it is made from. The ultimate elongation of the aluminum is 3% and the ultimate elongation of the FRP is 2.5%. As shown in FIG. 16, the link 100 undergoes significant elongation prior to separation. For example, the original length of a tested link was 330 mm. Separation of the rod from the outer neck portion occurred at 52 mm, resulting in an elongation of approximately 16%.

The above disclosed interlocking joint provides a controllable failure mode in the event of extreme tensile loading. The neck 108, groove 104, and projection 114 can be varied as desired to provide a selected load at which failure begins to occur. The length of the rod 102 behind annular projection 114 can be varied to provide a selected amount of ultimate elongation of link 100. The length of the rod 102 behind annular projection 114 can be varied to provide a selected amount of energy to separate the portion of the casting 106 and 108B completely from the rod 102.

Although the present invention has been described with reference to preferred embodiments, workers skilled in the art will recognize that changes may be made in form and detail without departing from the spirit and scope of the invention.

We claim:

1. A link assembly comprising:

(a) a rod, formed from a matrix of heat resistant reinforcing fibers bound together by a less heat resistant resin, having an annular groove at a preselected distance from an end of the rod; and (b) a casting formed from molten metal introduced and cooled on the rod so that a continuous interface is formed between the metal and fibers as resin is thermally altered, the casting including (i) a neck surrounding a portion of the rod adjacent the groove;

(ii) an annular projection filling the groove and forming an interlace with exposed fibers in the groove, and (iii) a connector formed at a terminating end of the neck and extending beyond the end of the rod, wherein, the continuous interface comprises a layer between the casting and the rod from which the resin has degraded exposing some of the fibers to the metal from which the casting is formed, the metal being continuously formed amongst and around the exposed fibers, securely interlocking and interconnecting therewith.

2. The link assembly specified in claim 1 wherein the connector is formed as an eyelet.

3. The link assembly specified in claim 1 wherein the rod is an elongated member of substantially uniform cross-section.

4. The link assembly specified in claim 1 wherein the rod has a smooth, continuous outer surface.

5. The link assembly specified in claim 1 wherein the annular groove in the rod is a uniform channel.

6. The link assembly specified in claim 1 wherein a joint is formed between the projection and the groove.

7. The link assembly specified in claim 1 wherein an interface is formed between the projection and the groove as exposed resin in the groove is thermally altered.

8. A structural component having a fiber-reinforced plastic body and a metal member on said body, wherein:

a main body comprises of a matrix of substantially continuous reinforcing fibers having a heat resistance greater than the melting point of said metal, said fibers further being bound together by a resin that has significantly less resistance to heat decomposition than said fibers, the main body having an annular groove at a preselected distance from an end thereof;

the metal member comprises a casting formed from molten metal introduced and cooled on the body around a portion of the body including said annular groove, wherein the structural component comprises:

a layer at an interface between the metal member and the body from which the resin has degraded exposing some of the fibers to the metal, the metal being continuously formed amongst and around the exposed fibers, securely interlocking and interconnecting therewith.

9. The structural component of claim 8 wherein the layer has a thickness in a range from 30 to 70 micrometers.

* * * * *